United States Patent [19]

Finkel

[11] 4,392,272

[45] Jul. 12, 1983

[54] TRACK AND PANEL GUIDE FOR SLIDING SHOWER DOORS OR THE LIKE

[75] Inventor: Abram R. Finkel, Royal Palm Beach, Fla.

[73] Assignee: KSD Industries, Inc., Southampton, Pa.

[21] Appl. No.: 234,859

[22] Filed: Feb. 17, 1981

[51] Int. Cl.[3] ..... A47K 3/14; E05D 13/02

[52] U.S. Cl. ..... 16/95 R

[58] Field of Search ..... 16/90 R, 95 R, 93 R; 4/607, 608, 609, 610; 49/409, 410

[56] References Cited

U.S. PATENT DOCUMENTS

| | | | |
|---|---|---|---|
| D. 216,957 | 3/1970 | Dallaire | D13/6 |
| D. 242,800 | 12/1976 | Schmidt | D13/6 |
| 2,761,533 | 9/1956 | Grossman | 49/411 |
| 2,911,654 | 11/1959 | Bruno | 4/607 |
| 2,929,115 | 3/1960 | Beckstrom . | |
| 3,054,118 | 9/1962 | Bullock | 4/149 |
| 3,384,998 | 5/1968 | Abramson | 16/90 X |
| 3,615,144 | 10/1971 | Plemeng | 49/411 |
| 3,852,916 | 12/1974 | Laby | 49/409 |
| 3,942,197 | 3/1976 | Sudmann et al. | 16/90 X |
| 4,014,070 | 3/1977 | Rifkin | 16/90 |
| 4,051,633 | 10/1977 | Voegele, Jr. | 49/911 |
| 4,258,443 | 3/1981 | Baus | 16/90 X |

*Primary Examiner*—Paul A. Bell
*Assistant Examiner*—John S. Brown
*Attorney, Agent, or Firm*—Robert C. Podwil

[57] ABSTRACT

Guide means for sliding shower doors and the like includes a lower track member having a inclined upper face, an upstanding guide adjacent one edge thereof, and a guide track adjacent the other edge thereof. An outer door is guided by the upstanding guide and has a skirt which overlies it, and an inner door is coupled to and guided by the guide track, so that water impinging on the upper face of the lower track member can run off freely.

13 Claims, 5 Drawing Figures

TRACK AND PANEL GUIDE FOR SLIDING SHOWER DOORS OR THE LIKE

BACKGROUND OF THE INVENTION

This invention relates to a track and panel guide for sliding shower doors and the like. More particularly, this invention relates to a simple, relatively inexpensive, and readily cleaned track and panel guide.

Conventional tracks and panel guides for shower enclosures provide a pair of upwardly facing slots in which the panels rest and slide. Typically, such tracks are provided with side openings or holes to permit drainage of water that collects in the tracks. Nevertheless, as is well-known, such tracks tend to collect dirt, and are difficult to clean and keep clean.

Alternatives to the conventional track and panel guide have therefore been suggested. For example, in U.S. Pat. No. 4,014,070, issued Mar. 29, 1977, to Rifkin, it was proposed that the slots be eliminated entirely, and that specially devised guide members be used to couple the sliding panels to a single upstanding "ledge". In a somewhat similar fashion, in U.S. Pat. No. 3,942,197, issued Mar. 9, 1976, to Sudmann et al, a three-panel enclosure was proposed, wherein the lower edges of the respective panels were guided by interengagement with portions of a guide member having a continuous, non-slotted upper face.

It is a principal object of this invention to provide a track and panel guide for sliding shower doors or the like, wherein the track has an unobstructed upper surface, and wherein the lower edges of the panel are reliably and securely coupled to the panel guide in a secure and water-sealing manner.

It is another object of this invention to provide a track and panel guide which does not foster or permit the accumulation of water or dirt, and which may easily be cleaned.

A further object of this invention is to provide a track and panel guide for sliding shower doors of the like which is relatively inexpensive, may be readily assembled, and is structurally sound.

Other objects will appear hereinafter.

The foregoing and other objects of this invention are realized by apparatus in which an elongated lower track member provides an upper face inclined from an outer to an inner edge of the track, and a guide rail projecting upwardly from the upper face adjacent to the outer edge. A second guide rail projects inwardly from the inner face, preferably as an extension of the upper face, and, together with other elements of the track member, defines an inwardly facing guide channel along the inner edge of the track member. Guide members coupled to the inner panel member of a sliding door can project into the guide channel and interengage with it to secure the lower edges of that panel member to the track. The outer panel member has a downwardly opening channel which receives and overlies the first guide rail. The first guide rail provides a rub strip which sealingly engages the outer panel member, and the outer panel member provides a continuous decorative outer skirt along the lower margin of the outer panel, to hide the track and enhance the appearance of the entire assembly.

BRIEF DESCRIPTION OF THE DRAWINGS

There are seen in the drawings a form of the invention which is presently preferred, it being understood that this invention is not limited to the precise arrangements and instrumentalities shown.

DETAILED DESCRIPTION OF PREFERRED EMBODIMENT

Figure 1:
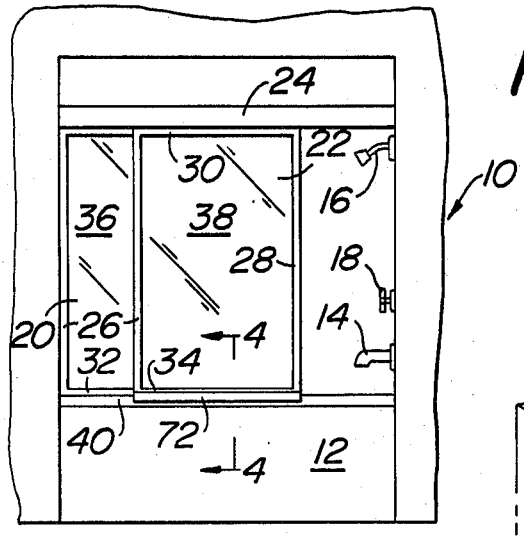
FIG. 1 is a view of a shower enclosure, including sliding panels, of the sort with which the present invention may be used.

Referring now to the drawings in detail, wherein like reference numerals indicate like elements, there is seen in FIG. 1 a tub and shower enclosure designated generally by the reference numeral 10. The enclosure 10, as is conventional, has a tub 12, within which there are disposed the usual faucet 14, shower head 16 and fixtures 18. A closure for the enclosure 10 consists of inner and outer sliding doors 20, 22, suspended in a conventional manner by rollers (not shown), from a head rail 24. The panels 20, 22 are made up of side rail members 26, 28, upper rail members 30, lower rail members 32 and 34, and transparent panel members 36, 38. The lower rail members 32, 34 of the respective sliding doors 20 and 22 engage a lower track member 40 in a manner which will now be described in detail.

Figure 4:
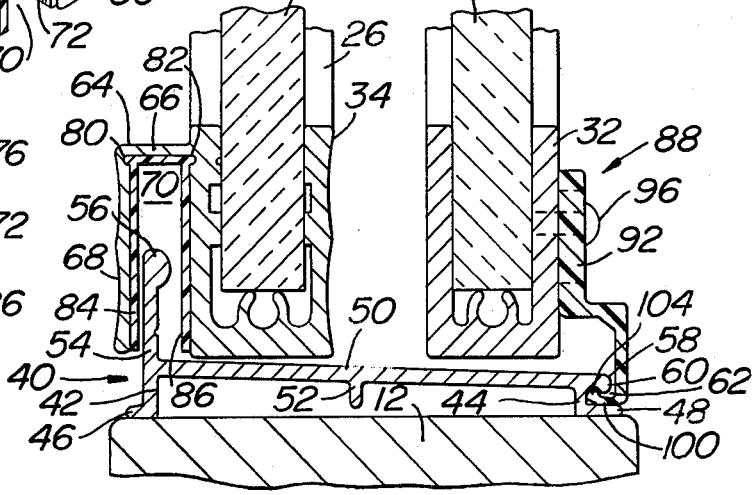
FIG. 4 is a cross-sectional view, taken along the line 4—4 in FIG. 1, showing details of the lower track member and guide members in accordance with the invention.

Referring now to FIG. 4, the lower track member 40, which may be most conveniently made as an aluminum extrusion, is supported on an upper surface of the tub 12 by a pair of downwardly extending support members, which may be conveniently referred to hereafter as an outer support member 42 and an inner support member 44. A flange 46 extends outwardly from the lower extremity of the outer support member 42 and a flange 48 extends inwardly from the inner support member 44. The outer and inner support members 42, 44 define, in the illustrated embodiment, outer and inner edges of the lower track member 40, and are interconnected by a member 50, which defines an upper face of the lower track member 40. As is seen in FIG. 4, the member 50 and the upper face are inclined downwardly from the outer to the inner edges of the lower track member 40. Such a configuration facilitates the runoff of water which impinges on the upper face toward the interior of the tub 12. A longitudinally extending reinforcement rib is disposed in the illustrated embodiment beneath the member 50, and serves to reinforce it.

A longitudinally extending guide rail 54 extends upwardly from the member 50 adjacent to the outer support member 42, and in the illustrated and presently preferred embodiment (which also constitutes the best mode contemplated for carrying out the invention), the guide rail 54 has an enlarged upper end 56.

A guide rail 58 projects inwardly and preferably as an extension of the member 50, and has a downwardly projecting end portion or enlargement 60. The enlargement 60 and adjacent portions of the inner support member 44 and flange 48 define a partly enclosed horizontally opening guide channel 62 extending longitudinally with respect to the inner edge of the lower track member 40.

As will now be explained, the guide rail 54 and cooperating structure provides a means for guiding the outer sliding door 22, and the guide channel 62 a means for guiding the inner sliding door 20.

Figure 3:
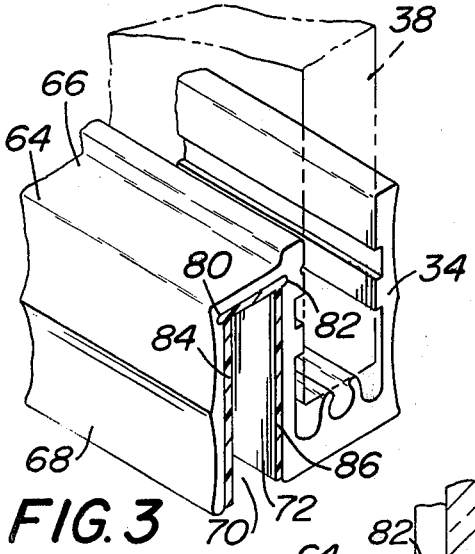
FIG. 3 is a partial pictorial view showing details of an outer panel member in accordance with the present invention.

Referring to FIGS. 3 and 4, the lower rail member 34 of the outer sliding door 22 provides an upwardly facing "U"-shaped channel, which receives an edge of the transparent panel 38. Projecting outwardly and downwardly from the lower rail member 34 is a skirt 64, which consists of a generally horizontally extending portion 66 and a downwardly extending portion 68. The outer face of the lower rail member 34, together with the horizontally extending portion 66 and downwardly extending portion 68 of the skirt 64 provide a downwardly opening channel, designated by the reference numeral 70, which overlies and receives within it the guide rail 54. A clip 72, preferably of rigid vinyl material is received within the channel 70, and provides, in effect, a liner against which the guide rail 54, and particularly its enlarged upper end 56, can bear.

Figure 5:
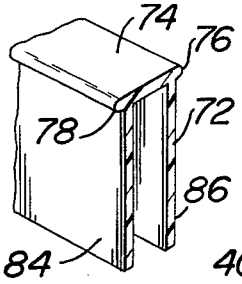
FIG. 5 is a pictorial detail view of a component of the present invention.

Referring now to FIG. 5, the clip 72 is seen in detail. The clip 72 includes a head end 74, beaded edges 76 and 78 of which may be snap fitted and received within complementary grooves 80 and 82 within the channel 70. Legs 84 and 86 of the clip 72 overlie respective inner and outer sides of the channel 70.

The legs 84 and 86 of the clip 72 slidably engage the guide rail 54, and the channel 70 and guide rail 54 provide, in effect, a barrier against the passage of water from the inner side of the outer sliding door 22 to the exterior of the enclosure 10. The skirt 64 also gives to the intersection of the lower track member 40 and outer sliding door 22 an attractive finished appearance, and eliminates from that area any upwardly extending openings which might catch water, dirt or residue.

Figure 2:
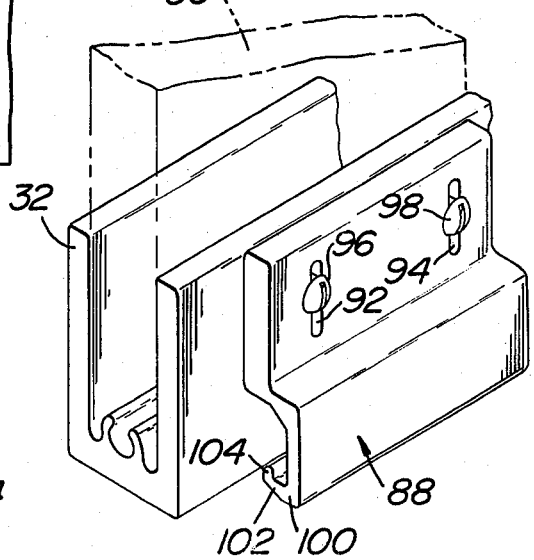
FIG. 2 is a partial pictorial view showing details of an inner panel member and guide member in accordance with the present invention.

Referring to FIGS. 2 and 4, the lower rail member 32 of the inner sliding door 20 likewise provides an upwardly opening "U"-shaped channel, for receiving the transparent panel 36. Affixed to the inside face of the lower rail member 32 at spaced locations, are guide members such as the illustrated guide member designated generally by the reference numeral 88. The guide members 88 include a downwardly extending mounting flange 90, advantageously provided with spaced slots 92 and 94 for vertical adjustment of the guide members 88 relative to the lower rail member 32. Conventional fastening means, such as the illustrated set-screws 96 and 98 can pass through the slots 92 and 94 to affix the mounting flanges 90 and guide members 88 to the lower rail member 32. Referring now to FIG. 4, the lower portion of the guide member 88 comprises a generally "C"-shaped portion, which includes a horizontally extending portion 100 which projects into the guide channel 62, and terminates in a diagonally upwardly extending portion 102 and an enlarged terminal portion 104. The enlarged terminal portion 104 and guide channel 62 prevent inward swinging of the inner sliding door 20. The horizontally extending portion 100, portion 102 and enlarged terminal portion 104, however, are so configured as to permit insertion of the guide members 88 into the guide channel 62 for installation of the sliding door 20.

The various elements of the above-described apparatus may be made from materials which are suited to their function, and their exact specifications will occur to those skilled in the art. The guide members 88, for example, may be made of rigid vinyl; the clip 72, as was stated above, likewise of vinyl; and the various rail members and lower track member 40 may advantageously be extruded aluminum.

The present invention may be embodied in other specific forms without departing from its spirit and essential attributes, and, accordingly, reference should be made to the appended claims rather than the foregoing specification as indicating the scope of the invention.

I claim:

1. Guide means for shower doors and the like having respective inner and outer sliding doors comprising: an elongated lower track member, a planar upper face inclined downwardly from an outer to an inner edge of said track member, a guide rail projecting upwardly from said upper face adjacent to said outer edge, and a partly enclosed horizontally opening guide channel disposed along the inner edge of said track member, first guide members coupled to the inner sliding door, said first guide members having a horizontally extending portion adapted to project into said guide channel and a terminal enlargement interengageable with said guide channel to slidably secure the inner sliding door to said lower track member, and a second guide member associated with the outer sliding door, said second guide member comprising a downwardly opening channel adapted to overlie and interengageably receive said guide rail.

2. Apparatus in accordance with claim 1, wherein said second guide member includes an enlarged upper end disposed within said downwardly opening channel.

3. Apparatus in accordance with claim 2, and liner means disposed within said downwardly opening channel and coupled thereto, said liner means providing a surface against which said guide rail may bear.

4. Apparatus in accordance with claim 3, wherein said liner means comprises a clip member of rigid vinyl, snap-fitted within said channel.

5. Apparatus in accordance with claim 4, wherein said first guide members are made of vinyl.

6. Apparatus in accordance with claim 1, wherein said downwardly opening channel is coupled to a lower rail member of the outer sliding door and comprises an outwardly and a downwardly extending flange portion projecting therefrom.

7. Apparatus in accordance with claim 6, wherein said downwardly extending flange portion defines a substantially continuous outer skirt along the lower margin of the outer sliding door.

8. Apparatus in accordance with claim 7, and liner means disposed within said downwardly opening channel and coupled thereto, said liner means and said first guide members being made of vinyl.

9. Apparatus in accordance with claim 8, wherein said second guide member includes an enlarged upper end, and said liner means comprises a clip member snap-filled within said channel.

10. For use in a sliding shower door assembly or the like, a lower track member having support members adjacent first and second lateral edges thereof, an upper face downwardly inclined from said first to said second lateral edges, a first guide rail projecting upwardly from said upper face adjacent said first lateral edge, and a second guide rail projecting inwardly from said second lateral edge, said support member adjacent said second lateral edge having a flange extending outwardly from the lower extremity of said support member, said second guide rail being juxtaposed to said flange so that said second guide rail and said flange define therebetween an outwardly opening guide channel, said second guide rail having a downwardly projecting enlarged terminal portion, said second guide rail and said flange defining therebetween a horizontally opening guide channel extending along said second lateral edge, said enlarged terminal portion partly constricting said guide channel.

11. Apparatus in accordance with claim 10, wherein, said second guide rail forms an extension of said upper face.

12. Apparatus in accordance with claim 11, wherein said track member is an extruded member.

13. Apparatus in accordance with claim 10, and an enlarged upper end on said first guide rail.

* * * * *